United States Patent [19]

Edminster

[11] Patent Number: 5,033,383

[45] Date of Patent: Jul. 23, 1991

[54] NO STORED ENERGY SAFE AND ARM DEVICE

[75] Inventor: Robert E. Edminster, Scottsdale, Ariz.

[73] Assignee: Motorola, Inc., Schaumburg, Ill.

[21] Appl. No.: 456,396

[22] Filed: Dec. 26, 1989

[51] Int. Cl.[5] ..... F42C 15/00

[52] U.S. Cl. ..... 102/254; 102/221

[58] Field of Search ..... 102/254, 256, 221, 222, 102/225, 226, 229

[56] References Cited

U.S. PATENT DOCUMENTS

| | | | |
|---|---|---|---|
| 4,188,885 | 2/1980 | Wolf et al. | 102/221 |
| 4,615,269 | 10/1986 | Holder | 102/221 |
| 4,635,552 | 1/1987 | Battle | 102/254 |
| 4,793,257 | 12/1988 | Bolieau | 102/221 |
| 4,848,235 | 7/1989 | Postler et al. | 102/256 |

*Primary Examiner*—David H. Brown

*Attorney, Agent, or Firm*—Frank J. Bogacz; Jordan C. Powell

[57] ABSTRACT

A safe and arm device for a fuze wherein the safe and arm device does not require stored energy and is activated by a solenoid operating on a pawl mechanism. The pawl in turn pulls a plunger against a detonating chamber in a ratchet-like manner. As the plunger is pulled towards the detonating chamber, a spring stem is compressed thus applying a force against the detonating chamber. Initially, the detonating chamber is locked in a safe position. After the pawl has pulled the plunger into compression against the detonating chamber, a lock on the detonating chamber is released and the detonating chamber pivots into an arm position. This allows a detonator within the chamber to detonate the fuze.

21 Claims, 1 Drawing Sheet

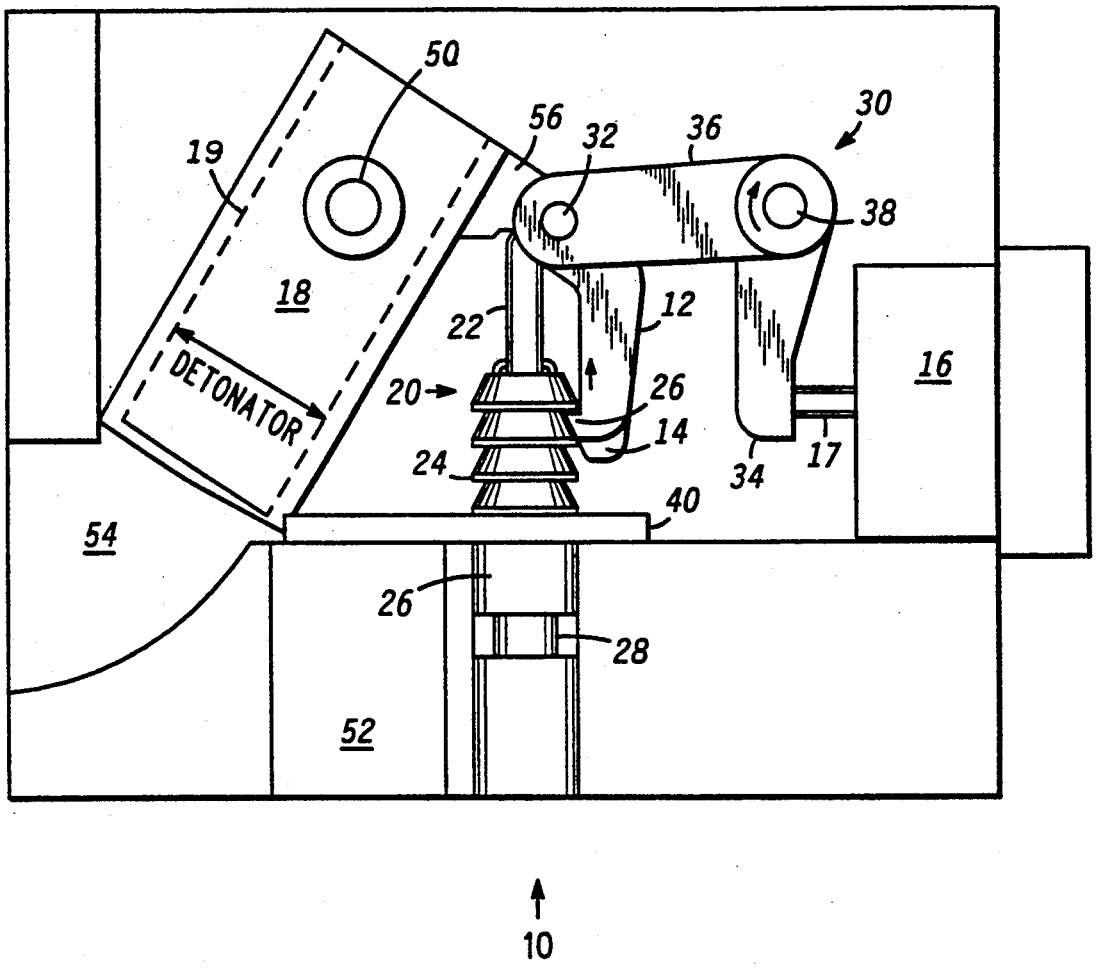
FIG. 1
FIG. 2
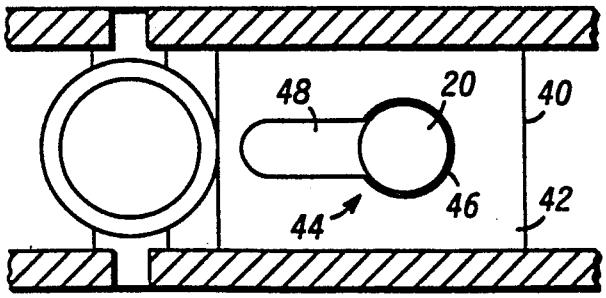

NO STORED ENERGY SAFE AND ARM DEVICE

BACKGROUND OF THE INVENTION

This invention relates, in general, to mechanical safety devices, and more specifically, to safing and arming devices which do not require stored energy.

Safing and arming devices are mechanisms which are used with fuzes on high explosive munitions. Fuzes, in turn, are designed to sense targets or the results of other prescribed conditions and initiate a train of fire or detonation in the munition. The safing and arming devices are designed to prevent premature activation of the fuze caused by extreme changes in heat or accidental impact.

Safing and arming devices of fuzes incorporated within Department of Defense (DoD) munitions are required to comply with strict safety requirements. Such requirements include the DoD's Safety Criteria for Fuze Design which specifies that the "fuze safety system should not utilize stored energy to remove safety features or provide arming energy unless no adequate environmentally derived energy is available". (MIL-STD-1316). Stored energy, for this purpose, includes batteries, springs having initial tension or compression, and explosives. Explosives are extensively used in munition fuzes because very few devices to date have been invented to utilize the limited electrical power available from environmental sources. Explosives are also the most dangerous stored energy source because heat from a fire (known as cook-off fire vulnerability), or accidental jarring, can cause the explosive to ignite.

Currently, the DoD is revising its safety criteria for fuzes (MIL-STD-1316) to eliminate all fuzes having any type of stored arming energy. One known device has been invented which utilizes only environmental energy. This device is described in a U.S. patent application by the same inventor as the present invention and assigned to the same assignee and entitled Safing and Arming Device having U.S. Ser. No. 431,253, now abandoned. However, this device works with a different action and is useful with different form factors and installation restraints.

SUMMARY OF THE INVENTION

Accordingly, it is an object of the present invention to provide a simple, inexpensive, safing and arming device which does not utilize stored energy.

A safe and arm device for a fuze wherein the safe and arm device does not require stored energy is activated by a solenoid operating on a pawl mechanism. The pawl in turns pulls a plunger against a detonating chamber in a ratchet-like manner. As the plunger is pulled towards the detonating chamber, a spring stem is compressed thus applying a force against the detonating chamber. Initially, the detonating chamber is locked in a safe position. After the pawl has pulled the plunger into compression against the detonating chamber, a lock on the detonating chamber is released and the detonating chamber pivots into an arm position. This allows a detonator within the chamber to detonate the fuze.

The above and other objects, features, and advantages of the present invention will be better understood from the following detailed description taken in conjunction with the accompanying drawings.

BRIEF DESCRIPTION OF THE DRAWINGS

FIG. 1 is a side view of a safe and arm device according to the present invention.

FIG. 2 is a top view of an element of the safe and arm device of FIG. 1 according to the present invention.

DETAILED DESCRIPTION OF THE INVENTION

Safe and arm devices are essential elements of fuzes used with munitions. Fuzes are devices which are "designed to sense a target or the result of other prescribed conditions . . . and initiate a train of fire or detonation in an item of ammunition such as a bomb with an explosive change". Department of Defense (DoD) Safety Specification, MIL-STD-1316C. The safe and arm device is the element of any fuze which precludes the initiation of the fuze process before the desired time or position.

Present DoD safety specifications state that fuzes are not to incorporate stored energy to remove safety features unless no adequate environmentally derived energy is available. Stored energy includes batteries, springs having an initial tension or compression, and explosive detonators. Environmental energy is energy readily available in the immediate environment of the fuze.

DoD is in the process of altering its safety specifications. The revised specifications are anticipated to eliminate use of stored energy from fuzes without exception.

A simple safe and arm device (SA) 10 which operates without the use of stored energy is shown in FIG. 1. As seen in FIG. 1, SA 10 is comprised of only a few parts which reduces the cost of constructing SA 10. Specifically, SA 10 comprises plunger 20, pawl arms 12 and 14 (pawl arm 14 in FIG. 1 is substantially hidden behind pawl arm 12, but is constructed in similar form as pawl arm 12), pawl link 30, solenoid 16, detonator chamber 18, and lock 40.

Plunger 20 comprises spring stem 22, ratchet teeth 24, a body 26, and a release neck 28. Spring stem 22 is inserted through a cavity which runs through a center axis of plunger 20. Spring stem 22 incorporates a spring which initially is not in tension or compression but is at rest. As plunger 20 is operated upon by pawl 12, as discussed subsequently, the spring of spring stem 22 is compressed generating an upward force.

In the preferred embodiment, there are three ratchet teeth 24 constructed out of body 26 at the upward exposed end of plunger 20. Ratchet teeth 24 are designed to interact with pawl arms 12 and 14 such that pawl arm 12 lifts plunger 20 upward by ratchet teeth 24 in three successive motions. Release neck 28 is located below ratchet teeth 24 along body 26 at a position allowing release neck 28 to align with lock 40 after the third successive upward lift of ratchet teeth 24. The diameter, or width, of release neck 28 is substantially less than that of body 26.

Pawl arm 12 is rotatably connected to pawl link 30 at joint 32. As seen in FIG. 1, pawl link 30 is a two-part mechanism. A first arm 34 of pawl link 30 which generally parallels pawl arm 12 is securely fastened perpendicularly to a second arm 36. As first arm 34 is operated on, it pivots about joint 38 causing second arm 36 to also pivot about joint 38. Joint 38 incorporates a spring which generates a rotational force as first and second arms 34 and 36 pivot. The force generated causes first and second arms 34 and 36 to pivot back into place with the end of each operational sequence. As second arm 36 pivots, joint 32 arcs upward and away from plunger 20. The upward arcing movement causes pawl arm 12 to lift upward. One of the ratchet teeth 24 of plunger 20 is engaged by a hook 26 of pawl arm 12 in the upward movement and plunger 20 is lifted in the direction of pawl arm 12's movement.

Pawl arm 14 is not connected to pawl link 30 nor to pawl arm 12. Rather, pawl arm 14 is connected to a pivot point generally adjacent to (and in FIG. 1, behind so as not to be seen in this figure) joint 32. The pivot point of pawl arm 14 allows pawl arm 14 to follow the contour of ratchet teeth 24 as plunger 20 is lifted upward. A hook on pawl arm 14, similar to hook (not shown in FIG. 1) 26 engages each groove of ratchet teeth 24 as plunger 20 reaches the upward limit of its upward motion. Therefore, as each successive lift by pawl arm 12 is completed (reaches the uphill limit), the hook of pawl arm 14 engages a successive groove of ratchet teeth 24 to prevent plunger 20 from retracting down.

First arm 34 of pawl link 30 is operated upon by solenoid 16. As solenoid 16 is engaged, arm 17 of solenoid 16 pushes upon a bottom portion of first arm 34 to pivot second arm 36 about joint 38.

FIG. 2 shows a top view of lock 40. Lock 40 comprises a plate 42 having a key-hole slot 44. In FIG. 2, plunger 20 us shown in a wide portion 46 of key-hole slot 44. The wide portion 46 is slightly larger than the diameter, or width, of plunger 20. A narrow portion 48 has a width slightly larger than the diameter of release neck 28 of plunger 20. When release neck 28 aligns with lock 40 after the successive upward movements of plunger 20, free movements along key-hole slot 44 is permitted. Prior to alignment of release neck 20 with lock 40, lock 40 is secured in its initial position by the diameter of plunger 20. The diameter of release neck 28 allows passage of narrow portion 48 through the slot in body 26 of plunger 20. Therefore, a force by detonator chamber 18 against lock 40 will only result in movement of lock 40 at the time release neck 28 and lock 40 align.

Detonator chamber 18 is a hollow cylinder which houses a detonator 19. As seen in FIG. 1, detonator chamber 18 rotates about joint 50. A bottom portion of detonator chamber 18 abuts against lock 40 preventing detonator chamber 18 to rotate until release neck 28 and lock 40 align. When detonator chamber 18 does rotate, it rotates until aligned with an arming channel 52 located in the body of the associated fuze. Prior to rotation, detonator chamber 18 is aligned with an escape channel 54 also located in the body of the associated fuze. If detonator 19 accidentally discharges prior to arming, the energy is released through escape channel 54 away from the fuze and away from potential activation of the associated munition. Furthermore, by utilizing safety mechanics of lock 40, detonator chamber 18 is prevented from arming the fuze before an intentional arming effort (successive activation of solenoid 16) is instigated.

The force to rotate detonator chamber 18 about joint 50 and into alignment with arming channel 52 is obtained from spring stem 22. As the spring of spring stem 22 is compressed with the successive upward movements of plunger 20, a force is applied to lip 56 of detonator chamber 18. Lip 56 rests upon the top portion of spring stem 22. At the time release neck 28 aligns with lock 40, the force in spring stem 22 is greatest. As narrow slot 48 slips past release neck 28, spring stem 22 forces lip 56 up causing detonator chamber 18 to rotate into arm position.

As can be seen throughout this description of the preferred embodiment, energy to operate SA 10 for arming the associated fuze is generated by solenoid 16. Solenoid 16 obtains its energy from a wind driven turbine which is mounted on the surface of the associated munition. The generator is not operational until the munition is separated from its carrier, such as an aircraft. As the munition is released from the aircraft, the generator is exposed to a wind current passing along the sides of the munition. Electrical energy generated by the high-speed generator is then used by the fuze to dispense the energy to solenoid 16 at designated time intervals. The time intervals correlate with the alternating pulses of solenoid 16. Initially, the spring of plunger 20 of safe and arm device 10 is at rest without compression. As solenoid 16 pulsates, it causes energy for arming the fuze to be stored by compressing the plunger spring, and ultimately releases the safety feature of lock 40. This fulfills the objectives of DoD safety criteria for fuze design that the fuze utilize no stored energy to remove safety features or provide arming energy. The simplistic nature of the plunger/ratchet operation allows for easy and inexpensive construction.

Thus there has been provided, in accordance with the present invention, a safe and arm device that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A safe and arm device which operates without the use of stored energy, the safe and arm device including a detonator, the safe and arm device comprises:

plunger means;

actuator means for moving said plunger means in successive motions;

chamber means for storing the detonator;

said plunger means for supplying a force to said chamber means to cause said chamber means to align into an arm position when said force applied to said chamber means reaches a predetermined magnitude; and said actuator means coupled to said plunger means.

2. A safe and arm device according to claim 1 wherein said actuator means comprises:

solenoid means for generating successive pulses of mechanical movement;

means for successively supplying said pulses of mechanical movement from said solenoid means to said plunger means; and said solenoid means coupled to said means for successively supplying.

3. A safe and arm device according to claim 1 wherein said detonator is inserted into said chamber means.

4. A safe and arm device according to claim 1 wherein the safe and arm device further comprises:

lock means for securing said chamber means into a safe position until said plunger means has completed a predetermined number of successive motions;

said lock means connected to said plunger means; and
said lock means abutting against a bottom portion of said chamber means.

5. A safe and arm device according to claim 4 wherein said lock means comprises:
a lock plate including a first aperture;
said lock plate further including a second aperture;
said first aperture having a substantially larger diameter than said second aperture;
said plunger means inserted into said first aperture;
said plunger means having a release neck, said release neck having a diameter slightly smaller than said second aperture;
an end of said lock plate abutting said chamber means; and
said lock plate moving away from said chamber means when said release neck moves into alignment with said second aperture of said lock plate to allow said chamber means to align into said arm position.

6. A safe and arm device according to claim 1 wherein said plunger means comprises:
stem means for spring loading said plunger means to generate said force as said actuator moves said plunger means;
stepped coupling means for coupling said actuator to said plunger means in ratchet fashion;
said stem means and said stepped coupling means coupled together;
said stem means abutting against said chamber means; and
said actuator means coupled to said stepped coupling means.

7. A safe and arm device according to claim 6 wherein said actuator means comprises:
solenoid means for generating successive pulses of mechanical movement;
means for repeatedly supplying said pulses of mechanical movement from said solenoid means to said plunger means; and
said solenoid means coupled to said means for successively supplying.

8. A safe and arm device according to claim 7 wherein said means for successively supplying comprises:
a pawl arm including a hooked end, said hooked end conforming to said stepped coupling means to allow said pawl arm to move said plunger means in said ratchet fashion;
said pawl arm successively coupling said stepped coupling means;
pawl link means for coupling said pawl arm to said solenoid means, said pawl link means fastened to said pawl arm to allow said pawl arm to pivot with respect to said pawl link means.

9. A safe and arm device according to claim 7 wherein said acutuator means further comprises pawl lock means for locking said plunger means in place after each of said repeated motions, said pawl lock means coupled in said plunger means.

10. A method for safing and arming a fuze without use of stored energy comprising the steps of:
coupling a solenoid to a pawl having a hooked end;
coupling said pawl to a plunger having a series of ratchet teeth conforming to said hooked end of said pawl;
abutting said plunger against a detonator chamber;
locking said detonator chamber into a safe position;
generating a series of pulses within said solenoid;
pulling said ratchet teeth toward an abutting end of said plunger;
generating a force against said detonator chamber as said ratchet teeth are pulled toward said abutting end, said force generated within said plunger;
unlocking said detonator chamber after each of said series of ratchet teeth have been pulled by said pawl; and
pushing said detonator chamber into an arm position using said force generated by said plunger.

11. A method for safing and arming a fuze without use of stored energy comprising the steps of:
locking a detonator chamber into a safe position;
compressing in successive motions a plunger against said detonator chamber to build a force operating against said detonator chamber;
unlocking said detonator chamber; and
using said built-up force to pivot said detonator chamber into an arm position.

12. A safe and arm device which does not require stored energy, the safe and arm device including a detonator, the safe and arm device comprising:
chamber means for storing the detonator;
means for successively applying a force against said chamber means to cause said chamber means to move into an arm position; and
said means for successively applying locking said chamber in a safe position until a series of successive movements of said means for successively applying has been completed.

13. A safe and arm device according to claim 12 wherein said means for successively applying comprises:
plunger means;
actuator means for moving said plunger means in repeating motions;
said plunger means for supplying said force to said chamber means to cause said chamber means to align into an arm position when said force applied to said chamber means reaches a designated magnitude; and
said actuator means coupled to said plunger means.

14. A safe and arm device according to claim 13 wherein said actuator means comprises:
solenoid means for generating a plurality of pulses of mechanical movement;
means for successively supplying said pulses of mechanical movement from said solenoid means to said plunger means; and
said solenoid means coupled to said means for successively supplying.

15. A safe and arm device according to claim 13 wherein said detonator is inserted into said chamber means.

16. A safe and arm device according to claim 13 wherein the safe and arm device further comprises:
lock means for securing said chamber means into a safe position until said plunger means has completed a predetermined number of said successive movements;
said lock means connected to said plunger means; and
said lock means abutting against a bottom portion of said chamber means.

17. A safe and arm device according to claim 16 wherein said lock means comprises:
a lock plate including a first aperture;
said lock plate further having a second aperture;

said first aperture including a substantially larger diameter than said second aperture;

said plunger means inserted into said first aperture;

said plunger means having a release neck, said release neck having a diameter slightly smaller than said second aperture;

an end of said lock plate abutting said chamber means; and siad lock plate moving away from said chamber means when said release neck moves into alignment with said second aperture of said lock plate to allow said chamber means to align into said arm position.

18. A safe and arm device according to claim 13 wherein said plunger means comprises:

stem means for spring loading said plunger means to generate said force as said actuator moves said plunger means;

stepped coupling means for coupling said actuator to said plunger means in ratchet fashion;

said stem means and said stepped coupling means coupled together;

said stem means abutting against said chamber means; and said actuator means coupled to said stepped coupling means.

19. A safe and arm device according to claim 18 wherein said actuator means comprises:

solenoid means for generating a plurality of pulses of mechanical movement;

means for repeatedly supplying said pulses of mechanical movement from said solenoid means to said plunger means; and said solenoid means coupled to said means for successively supplying.

20. A safe and arm device according to claim 19 wherein said means for successively supplying comprises:

a pawl arm including a hooked end, said hooked end conforming to said stepped coupling means to allow said pawl arm to move said plunger means in said ratchet fashion;

said pawl arm repeatedly coupling said stepped coupling means;

pawl link means for coupling said pawl arm to said solenoid means, said pawl link means fastened to said pawl arm to allow said pawl arm to pivot with respect to said pawl link means.

21. A safe and arm device according to claim 19 wherein said acutator means further comprises pawl lock means for locking said plunger means in place after each of said successive motions, said pawl lock means successively coupled to with said plunger means.

* * * * *